US005653319A

United States Patent [19]

Wang

[11] Patent Number: 5,653,319

[45] Date of Patent: Aug. 5, 1997

[54] RETRACTABLE HANDLE FOR A WHEELED TRAVEL BAG

[76] Inventor: King-Sheng Wang, No. 569, Ching-Kuo Rd.,, Ta-Chia Chen, Taichung Hsien, Taiwan

[21] Appl. No.: 531,397

[22] Filed: Sep. 21, 1995

Related U.S. Application Data

[63] Continuation-in-part of Ser. No. 377,992, Jan. 25, 1995, abandoned .

[51] Int. Cl.[6] ..... A45C 5/14; A45C 13/26

[52] U.S. Cl. ..... 190/115; 190/18 A; 190/39; 16/115; 280/37; 280/655

[58] Field of Search ..... 190/18 A, 39, 190/115; 280/37, 655, 655.1, 47.315; 16/115

[56] References Cited

U.S. PATENT DOCUMENTS

| | | | |
|---|---|---|---|
| 4,577,877 | 3/1986 | Kassai | 16/115 X |
| 4,754,985 | 7/1988 | Im et al. | 280/47.29 X |
| 5,127,664 | 7/1992 | Cheng | 280/655 |
| 5,178,404 | 1/1993 | Citen | 280/655.1 X |
| 5,291,976 | 3/1994 | Ku | 190/18 A |
| 5,308,103 | 5/1994 | Chin-Sung | 280/655.1 X |
| 5,355,890 | 10/1994 | Hsieh | 16/115 X |
| 5,393,079 | 2/1995 | Wang | 280/655.1 |
| 5,400,472 | 3/1995 | Chang | 16/115 |
| 5,407,040 | 4/1995 | Hu | 16/115 X |
| 5,499,702 | 3/1996 | Wang | 190/115 |

FOREIGN PATENT DOCUMENTS

| | | | |
|---|---|---|---|
| 4-183674 | 6/1992 | Japan | 280/655 |

*Primary Examiner*—Sue A. Weaver
*Attorney, Agent, or Firm*—Bacon & Thomas

[57] ABSTRACT

A retractable handle includes two parallel sleeves, two inner tubes joined by a hand grip and moved in and out of the sleeves, and a control bar having two opposite beveled ends respectively inserted into the inner tubes and coupled to the hand grip by a respective slip joint, wherein when the control bar is depressed, the beveled ends are moved downwards to force two spring-supported retainer rods of the inner tubes out of respective locating holes on the sleeves, permitting the inner tubes to be pushed upwards by springs inside the sleeves, and therefore the inner tubes can be pulled out of the sleeves by the hand grip.

1 Claim, 10 Drawing Sheets

RETRACTABLE HANDLE FOR A WHEELED TRAVEL BAG

CROSS-REFERENCE TO RELATED APPLICATION

The present invention is a continuation-in-part of U.S. patent application Ser. No. 08/377,992, filed on Jan. 25, 1995, entitled "RETRACTABLE HANDLE FOR TRAVEL BAGS, now abandoned.

BACKGROUND OF THE INVENTION

The present invention relates to retractable handles, and relates more particularly to a concealable retractable handle of a wheeled travel bag which can be conveniently moved between the extended position and the retracted position by actuation of a control bar.

A variety of travel bags are well known and intensively used by travelers for carrying things. FIGS. 1 and 2 show the structure of U.S. Pat. No. 5,355,980, entitled "SUITCASE WITH EXTENSIBLE HANDLE AND FOLDABLE PLATE FOR CARRYING ANOTHER SUITCASE THEREON", in which the strap mounting frame has a top portion provided with a horizontally extending first hook support; the handle member has two upright tubular portions which are inserted slidably into two upright tubular sleeves formed on the inner surface of the cover plate, and a horizontal second hook support extending across distal top ends of the tubular portions; the strap has a distal end which is provided with a hook unit that engages removably the first hook support when the strap is wound fully on the rotable shaft, or engages removably the second hook support after the strap is pulled to bind an object carried on the foldable plate. FIGS. 3 and 4 show the structure of "COLLAPSIBLE LUGGAGE TROLLEY" of U.S. Pat. No. 5,308,103, which includes a wheeled base with two parallel posts. Each of the posts has a lower, a middle and an upper tubular section telescopically received within each other and retained in the expanded position by the first and second retaining pins which are biased to extend through holes formed on the tubular sections. A plug movably received within the upper section is connected to a release bar disposed within the handhold on the wheeled base by a link to allow the plug to be controlled by the release bar. The plug has a round-headed lower end projecting out of the upper section and into the middle section which when moved to contact the second retaining pin between the middle section and the lower section acts upon and moves it back to break the retaining engagement between the middle section and the lower section. FIG. 5 shows the structure of CONTRACTION CONTROLLER FOR COLLAPSIBLE TYPE CONTRACTIBLE BAGGAGE CART of U.S. Pat. No. 5,178,404, in which a spring-biased sliding element carried by the controller body is pushed downwardly to cause retraction of stop members provided on the rods of the baggage carrier, thereby permitting the rods to be quickly collapsed into each other when a handle mounted at the top of the rods is also pushed downwardly. U.S. Pat. No. 5,291,976, entitled "WHEELED SUITCASE OF LUGGAGE SUPPORT WITH COLLAPSIBLE TOWING HANDLE", discloses a suitcase including a luggage member, a support structure attached to the luggage member, the support structure having a first horizontal member having two wheels thereon to facilitate towing on the ground, a second horizontal member, two tubular members coupling the first and second horizontal members. "HANDLE ASSEMBLY OF A BAGGAGE CART" of U.S. Pat. No. 5,400,772 is a length-adjustable handle assembly in which wen the operating means is operated to the first position, the flange surface of the plunger will contact the steel balls and force at least parts of them to fixedly engage with the holes of the outer tube when the holes of the operating sleeve are aligned with the holes of the outer tubes. When the operating means is operated to the second position, the fixed engagement between the steel balls and the holes of the outer tube is released. "PUSH-CART HANDLE HEIGHT ADJUSTING MECHANISM" of U.S. Pat. No. 4,577,877 is comprised an upper rod, a right lower rod, a left lower rod, locking holes, a right locking pin, a left locking pin, a right locking spring, a left locking pin, a right slide rod, a left slide rod, a connecting rod, and adjusting springs. When the upper rod is operated for upward or downward movement, the right locking pin and the left locking pin are disengaged from the locking holes to move onto the outer wall surfaces of the right lower rod and the left lower rod. The baggage of U.S. Pat. No. 5,407,040 has an extensible handle member controlled by a substantially Z-shaped spring retainer means.

The aforesaid U.S. patents teach different measures to position the handle. Only the handle of the suitcase shown in FIGS. 1 and 2 is made invisible when collapsed.

SUMMARY OF THE INVENTION

The present invention provides a retractable handle which comprises a substantially U-shaped hand grip having a top open chamber; a recessed mount securely fixed to the top side of the back panel of a travel bag and having two through holes; a sleeve holder securely fixed to the bottom side of the back panel of the travel bag and having two receptacles; two rigid sleeves securely connected between the receptacles of the sleeve holder and the through holes of the recessed mount, each rigid sleeve having a locating hole and a spring on the inside; a cover frame securely fixed to the recessed mount and having two tapered bottom holes respectively aligned with the through holes on the recessed mount; two inner tubes having a respective bottom end securely fixed with a respective end cap and inserted into one sleeve and stopped above one spring inside the respective sleeve and a respective top end extended out of one through hole on the recessed mount and one tapered bottom hole on the cover frame and securely fixed to one end of the hand grip by a respective pin, each inner tube comprising a first locating hole at an inner side at a higher elevation, a first spring-supported retainer rod extended out of the first locating hole and projecting into the locating hole on one sleeve to stop the respective inner tube from being moved relative to the respective sleeve, a second locating hole at an inner side at a lower elevation relative to the first locating hole, and a second spring-supported retainer rod extended out of the second locating hole and stopped against an inside wall of one sleeve; a substantially U-shaped control bar having two opposite beveled ends respectively inserted inserted through the top open chamber of the hand grip into the inner tubes, and two elongated holes, which receive the pins, which fasten the inner tubes and the two opposite ends of the hand grip together; and wherein when the control bar is depressed, the beveled ends of the control bar force the first spring-supported retainer rods of the inner tubes out of the locating holes on the sleeves, permitting the inner tubes to be pushed upwards by the springs inside the sleeves, and therefore the inner tubes can be pulled out of the sleeves by the hand grip.

DETAILED DESCRIPTION OF THE PREFERRED EMBODIMENT

Figure 1:
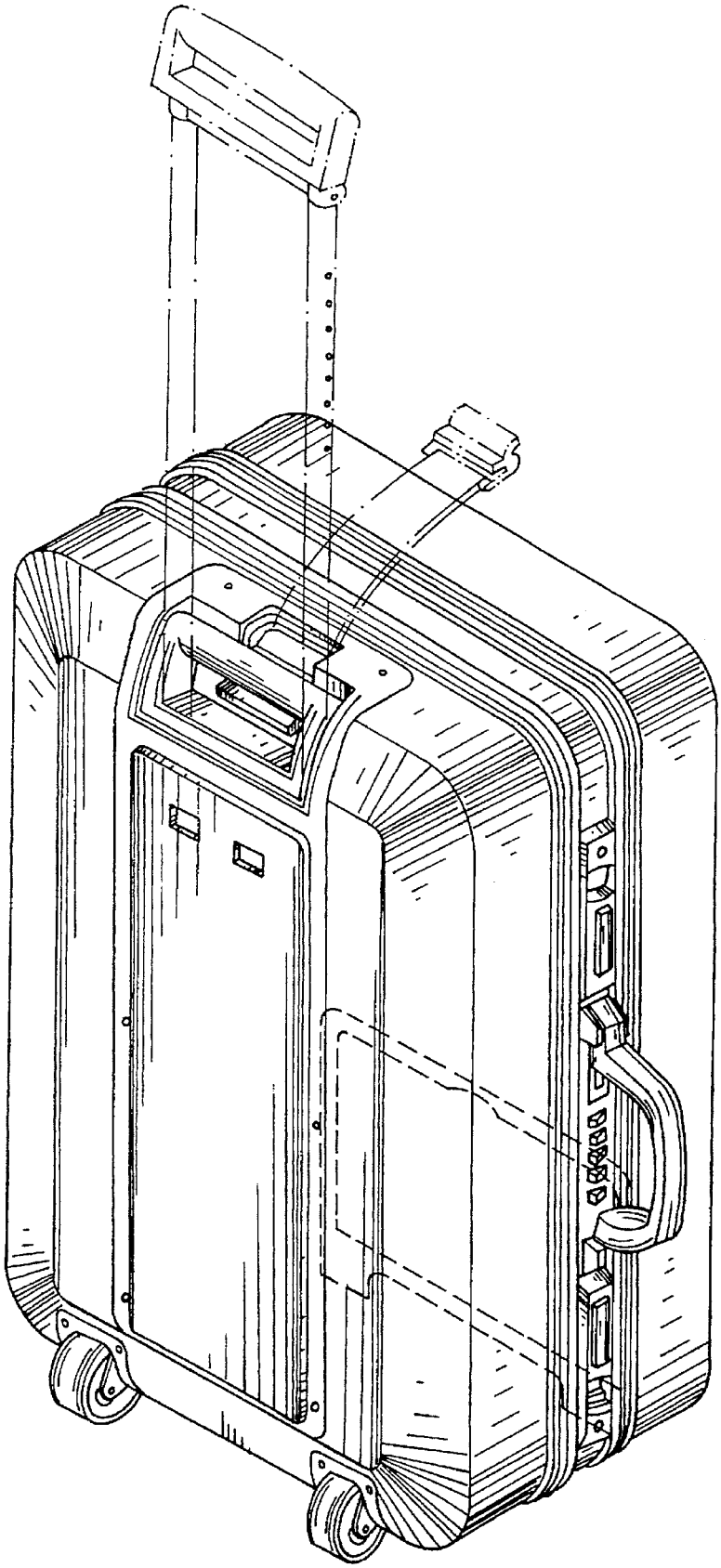
Fig.1 PRIOR ART
FIG. 1 is a perspective view of a suitcase with extensible handle and foldable plate according to U.S. Pat. No. 5,355,980.
Figure 2:
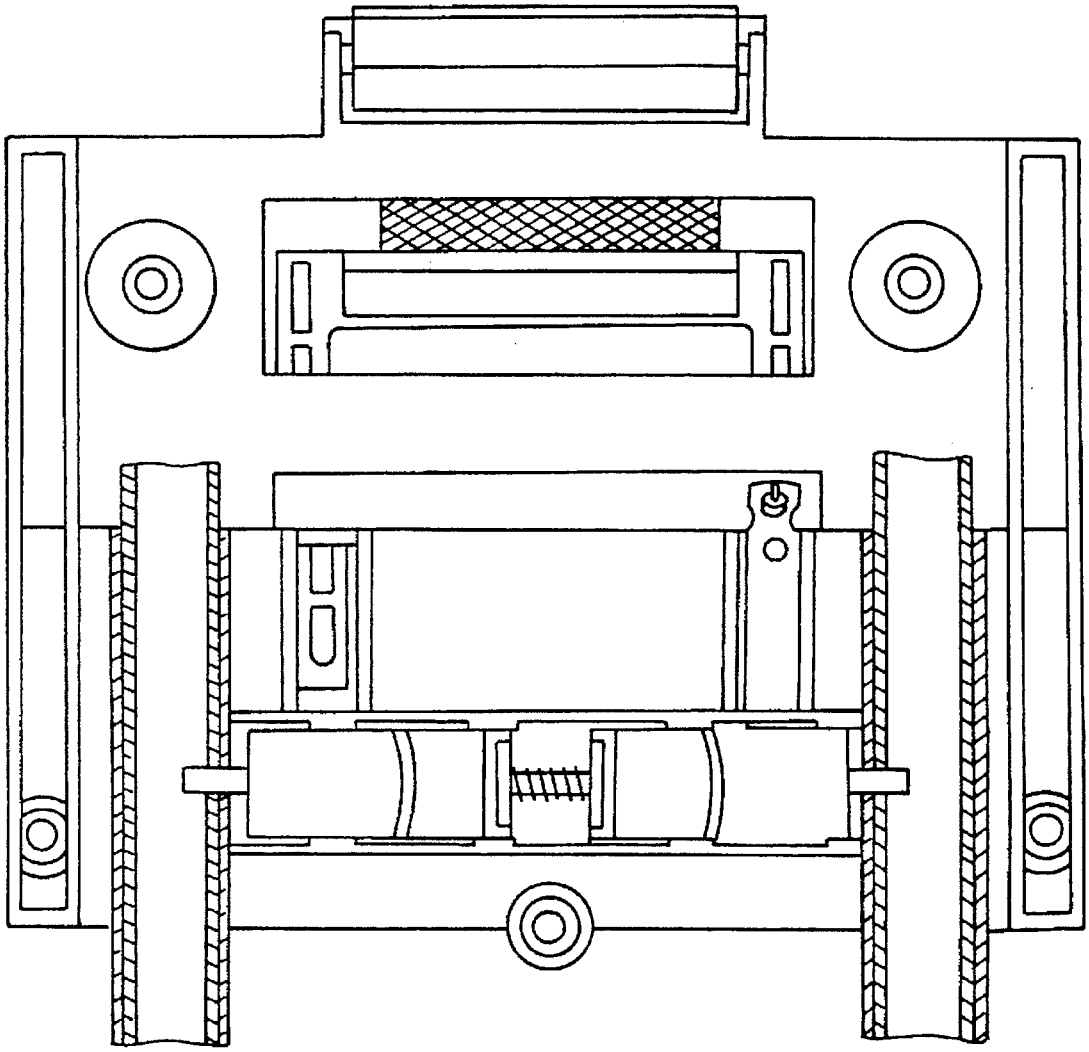
Fig. 2 PRIOR ART
FIG. 2 is a partial view in section of FIG. 1, showing the position of the extensible handle.
Figure 3:
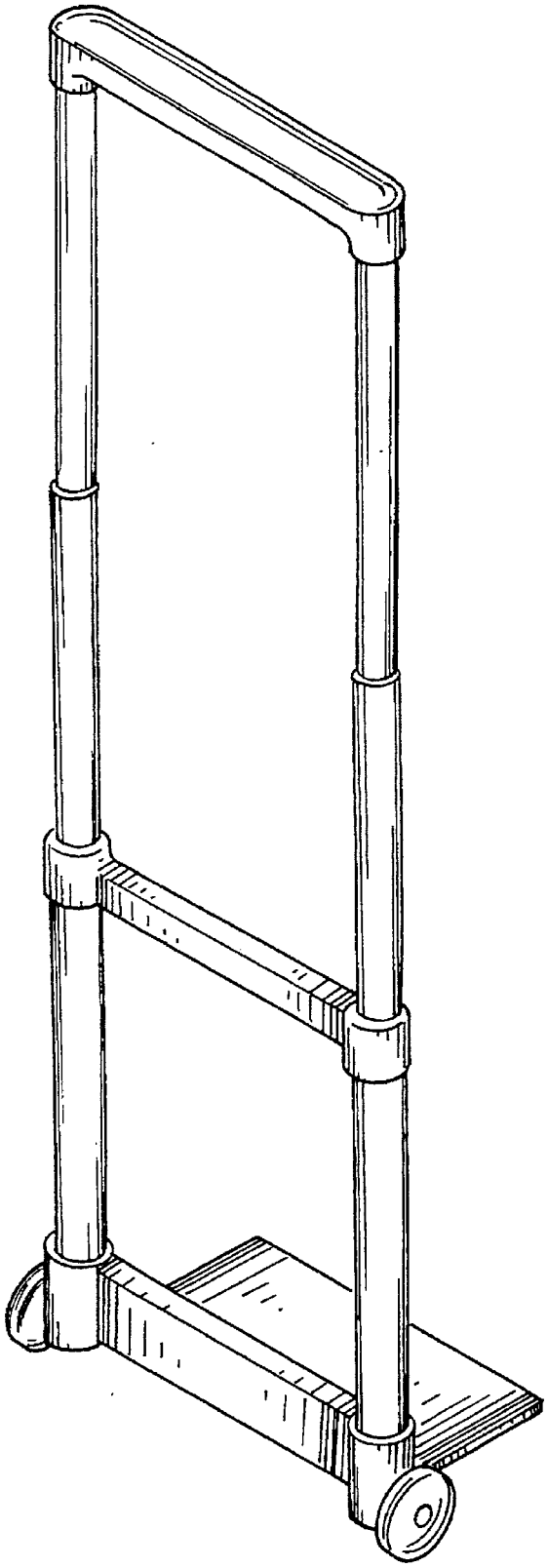
Fig. 3 PRIOR ART
FIG. 3 is an elevational view of a collapsible luggage trolley according to U.S. Pat. No. 5,308,103.
Figure 4:
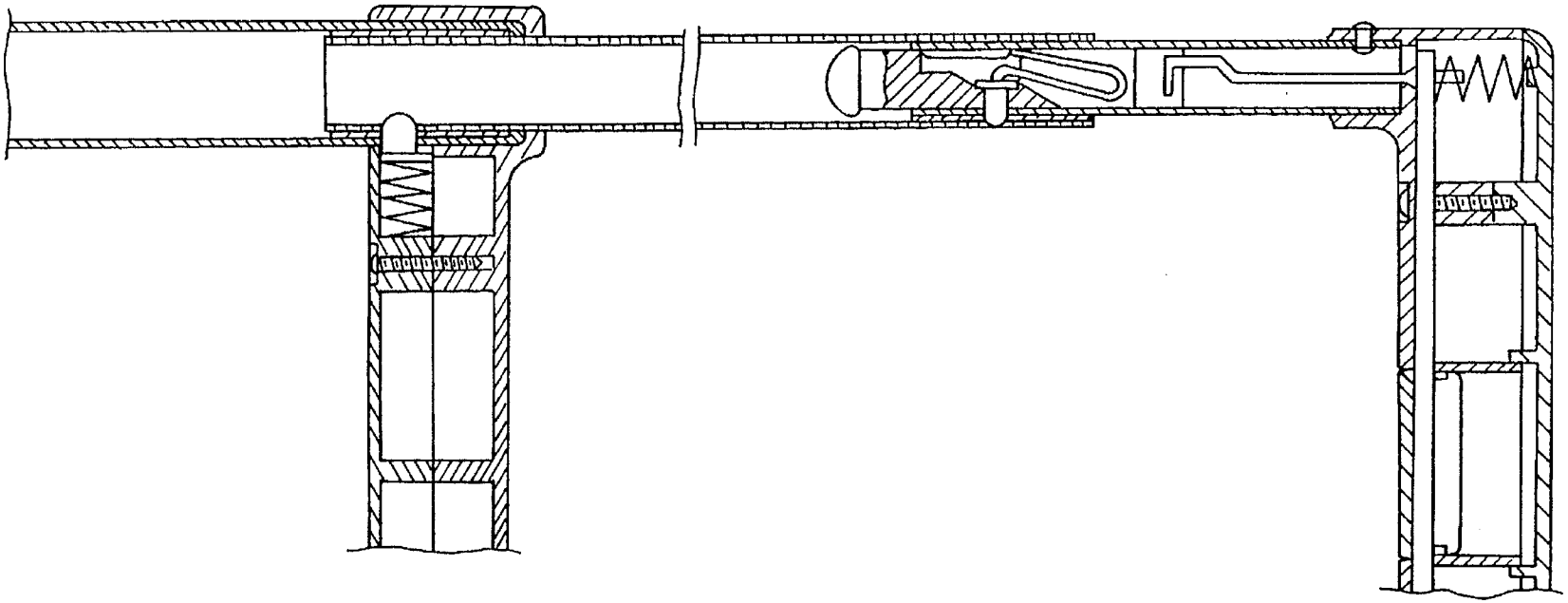
Fig. 4 PRIOR ART
FIG. 4 is a partial view in section in an enlarged scale of the collapsible luggage trolley shown in FIG. 3.
Figure 5:
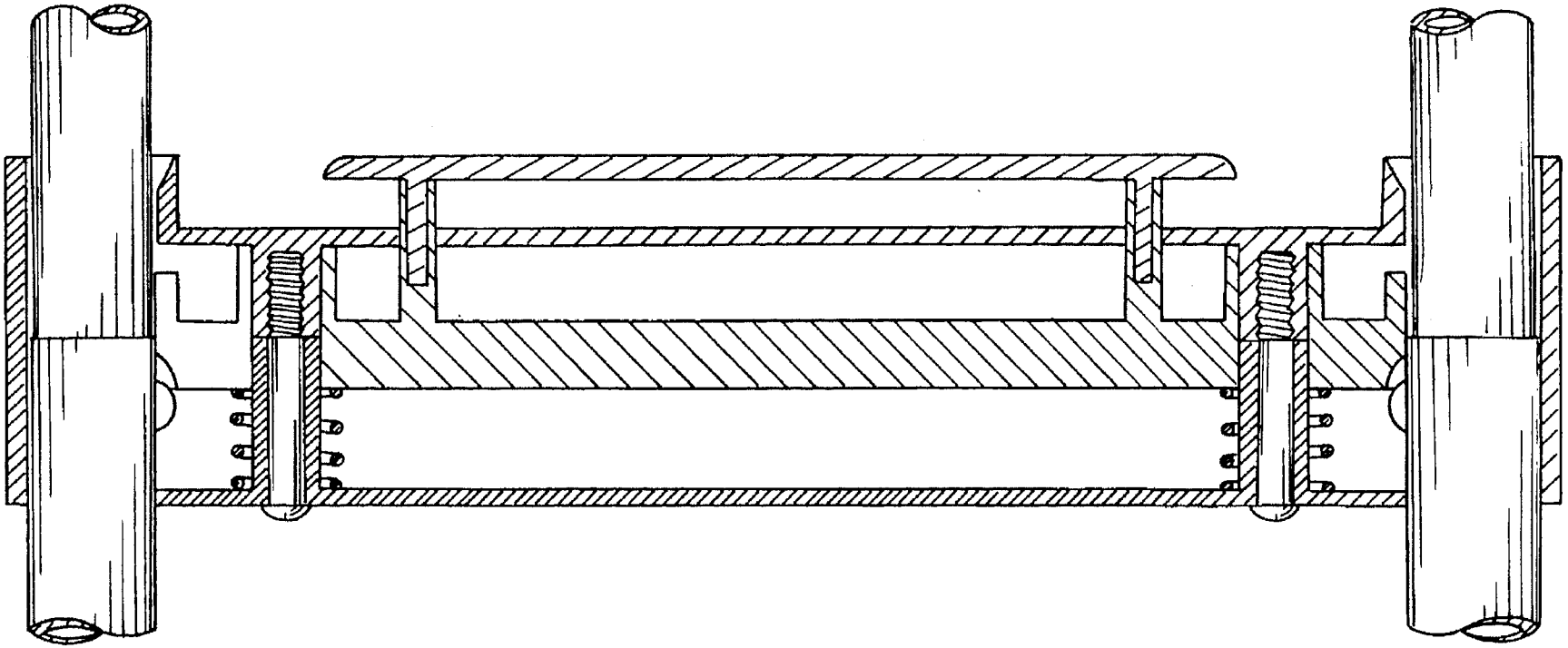
Fig. 5 PRIOR ART
FIG. 5 is a sectional view of a contraction controller for collapsible type contractible baggage cart according to U.S. Pat. No. 5,178,404.
Figure 6:
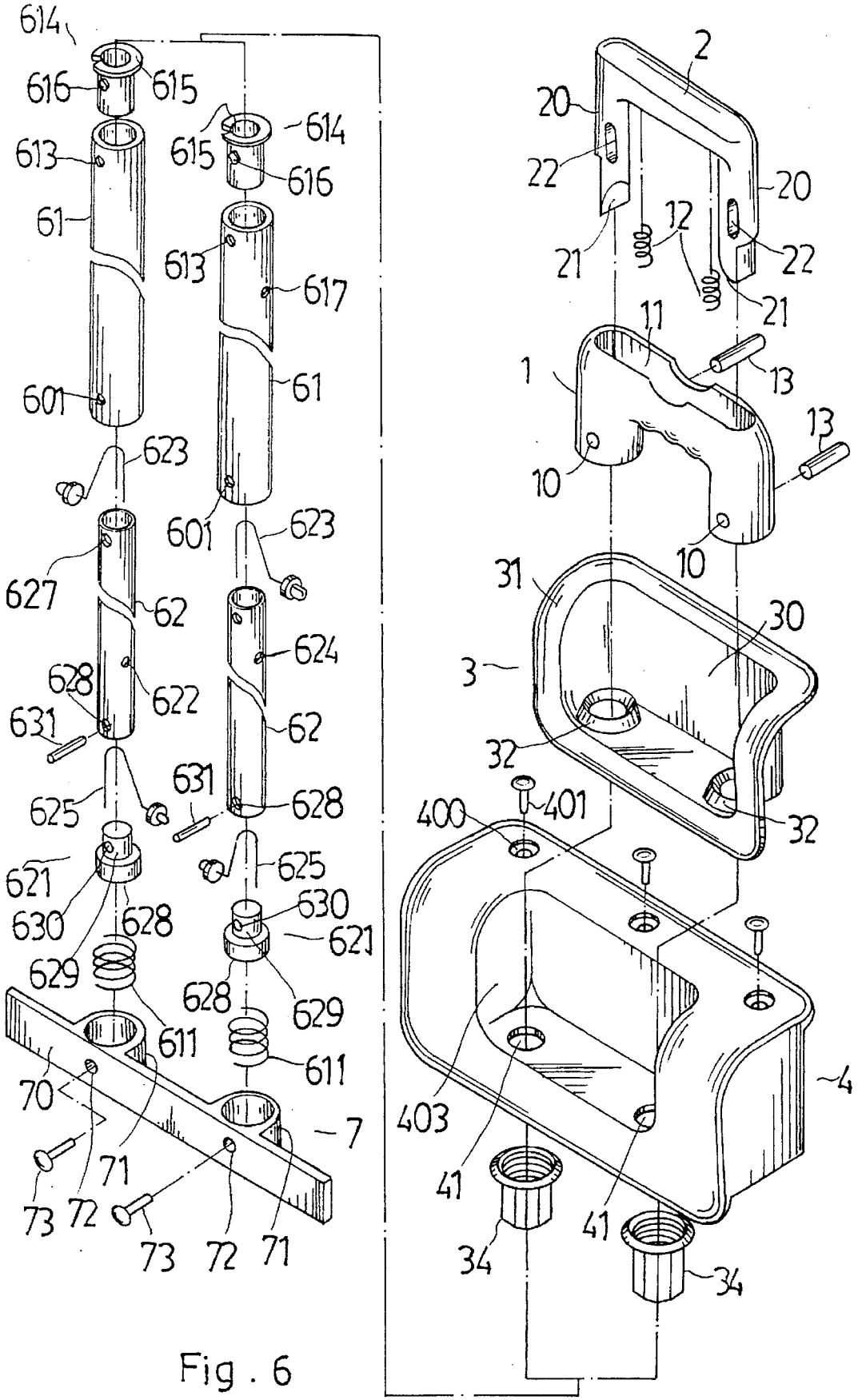
FIG. 6 is an exploded view of a retractable handle according to the present invention.
Figure 10:
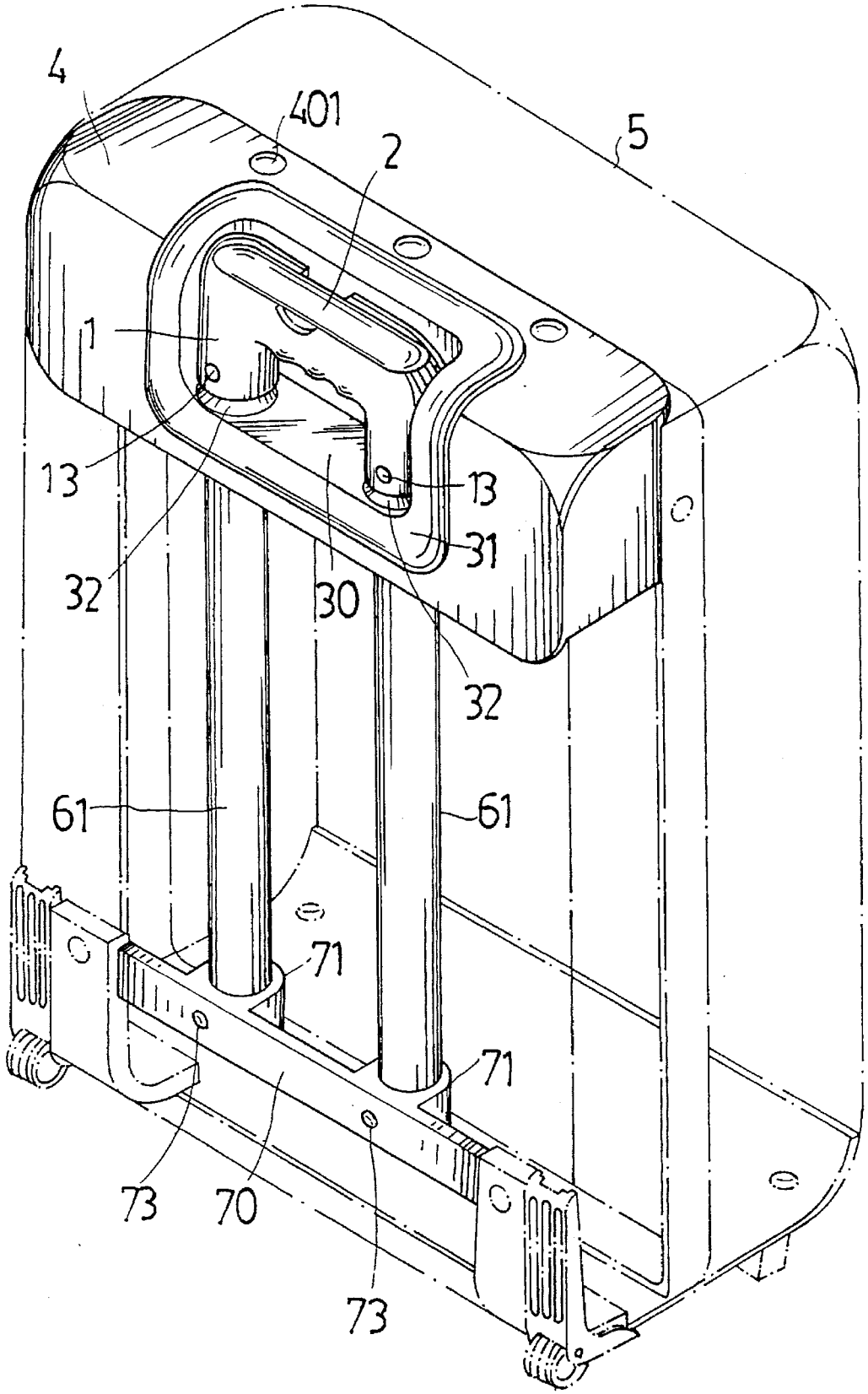
FIG. 10 is a perspective view showing the retractable handle of the present invention installed in a wheeled travel bag.

Referring to FIG. 6, a retractable handle in accordance with the present invention comprises a substantially U-shaped, hollow hand grip 1, a substantially U-shaped control bar 2, a cover frame 3, and a recessed mount 4. The hand grip 1 comprises two through holes 10 at two opposite ends thereof, a top chamber 11, and two springs 12 bilaterally mounted inside the top chamber 11. The control bar 2 is mounted within the top open chamber 11 of the hand grip 1, having two legs 20 at two opposite ends respectively inserted into the top chamber 11 of the hand grip 1. Each leg 20 comprises a beveled tip 21 and an elongated hole 22 near the beveled tip 21. The cover frame 3 defines an open chamber 30, having an outward peripheral flange 31 around the open chamber 30, two tapered bottom holes 32 are bilaterally disposed through the bottom side of the open chamber 30, and two externally threaded bottom stub tubes 33 (see FIG. 7) extend downwardly from the tapered bottom holes 32. The recessed mount 4 is mounted in the recessed top side of a travel bag 5 (see also FIG. 10), and includes a plurality of mounting holes 400, aligned at the top and fixed to the travel bag 5 by rivets 401, a receiving chamber 403, which receives the cover frame 3, and two through holes 41, which receive the externally threaded bottom stub tubes 33 of the cover frame 3.

Two outer sleeves 61 are respectively connected to the through holes 41 of the recessed mount 4 and are secured in place by a pair of respective lock nuts 34 threaded onto the externally threaded bottom stub tubes 33 of the cover frame 3. Each of the sleeves 61 has a hole 613 near the top end for mounting a respective tubular plug cap 614. The tubular plug cap 614 is inserted into one sleeve 61, and includes a rod 616 raised from the periphery and fitted into the hole 613 on the respective sleeve 61, and an outward top flange 615 stopped above the top end of the respective sleeve 61. Two inner tubes 62 are slidably inserted into the sleeves 61, each tube 62 having two locating holes 622 and 624 at different elevations and two spring-supported retainer rods 623 and 625 on the inside corresponding to the locating holes 622 and 624. Each of the inner tubes 62 has a bottom mounting hole 628 near the bottom end for mounting a respective bottom cap 621. The bottom cap comprises a cap head 628 stopped outside the bottom end of the respective inner tube 62, a plug rod 629 raised from the cap head 628 and fitted into the bottom end of the respective inner tube 62. The plug rod 629 has a hole 630 connected to the mounting hole 628 of the respective inner tube 62 by a pin 631. Each of the inner tubes 62 further has a top mounting hole 627 near the top end. When the top ends of the inner tubes 62 are inserted through the tapered bottom holes 32 from the bottom and into the hollow hand grip 1, then the legs 20 of the control bar 2 are respectively inserted into the top ends of the inner tubes 62, and then two pins 13 are respectively inserted into the holes 10 of the hand grip 1, the top mounting holes 627 of the inner tubes 62 and the elongated holes 22 of the control bar 2 to connect them together. Each of the sleeves 61 has a locating hole 617 corresponding to the locating hole 624 of the corresponding inner tube 62. When the sleeves 61 are respectively sleeved onto the inner tubes 62, the bottom ends of the sleeves 61 are coupled to a sleeve holder 7. The sleeve holder 7 is transversely secured to the travel bag 5 near the bottom side to hold the bottom ends of the sleeves 61, and includes an elongated mounting plate 70, two receptacles 71 raised from one side of the elongated mounting plate 70 for receiving the bottom end of each sleeve 61, and two mounting holes 72 through the elongated mounting plate 70. The bottom ends of the sleeves 61 are respectively inserted into the receptacles 71 of the sleeve holder 7, each having a mounting hole 601 connected to one mounting hole 72 by a rivet 73. Before the installation of the sleeves 61 in the receptacles 71, two springs 611 are respectively mounted within the bottom ends of the sleeves 61.

Figure 7:
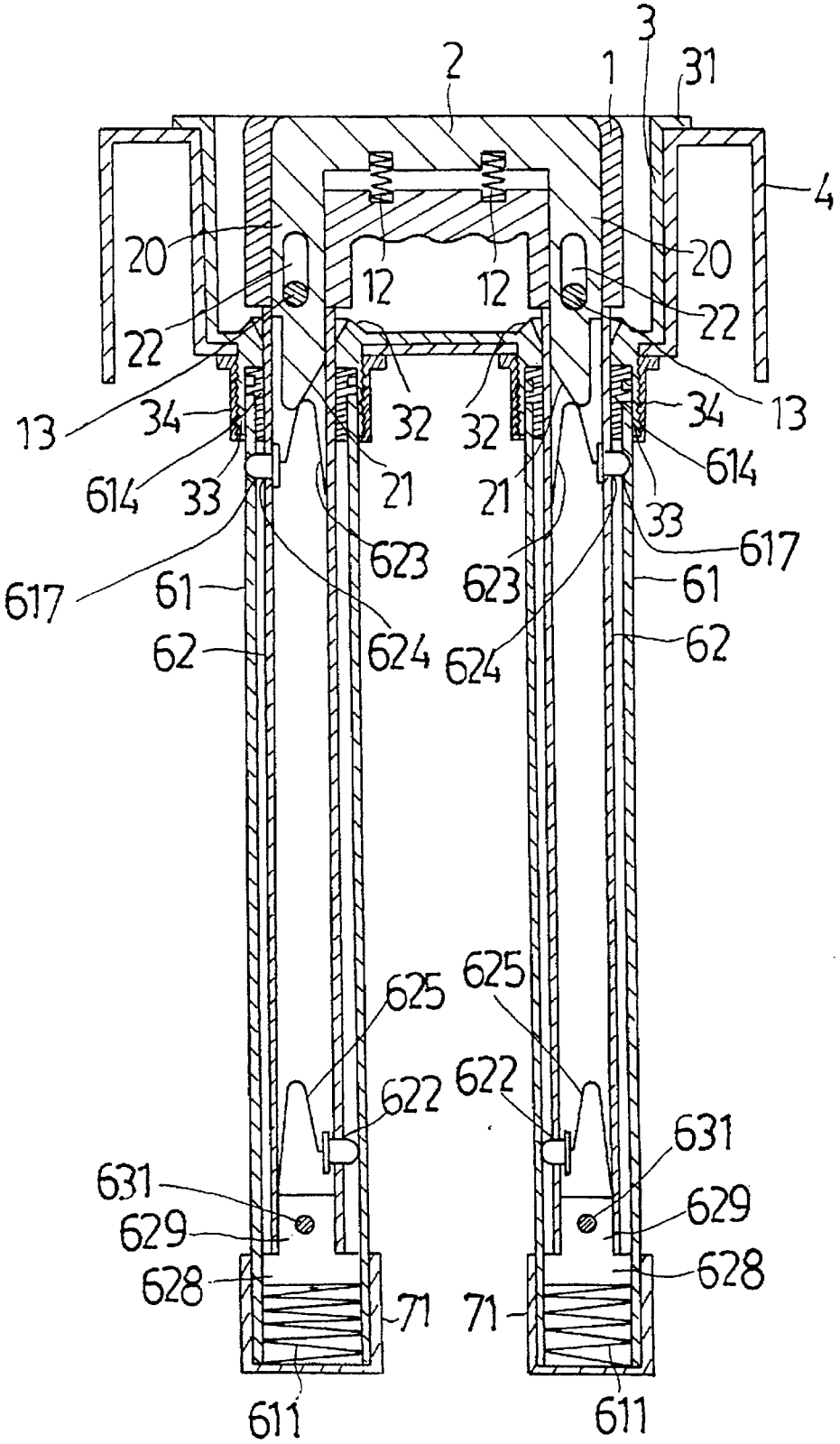
FIG. 7 is a sectional assembly view of the retractable handle shown in FIG. 6.

Referring to FIG. 7, when the retractable handle is collapsed, the hand grip 1 is received within the open chamber 30 of the cover frame 3, the spring-supported retainer rods 625 are respectively forced into the locating holes 622 of the inner tubes 62 and stopped against the inside wall of each sleeve 61, the spring-supported retainer rods 623 are respectively forced into the locating holes 624 of the inner tubes 62 and the locating holes 617 of the sleeves 61 to hold the retractable handle in the collapsed position, and at the same time the springs 611 are compressed by the bottom caps 621 of the inner tubes 62.

Figure 8:
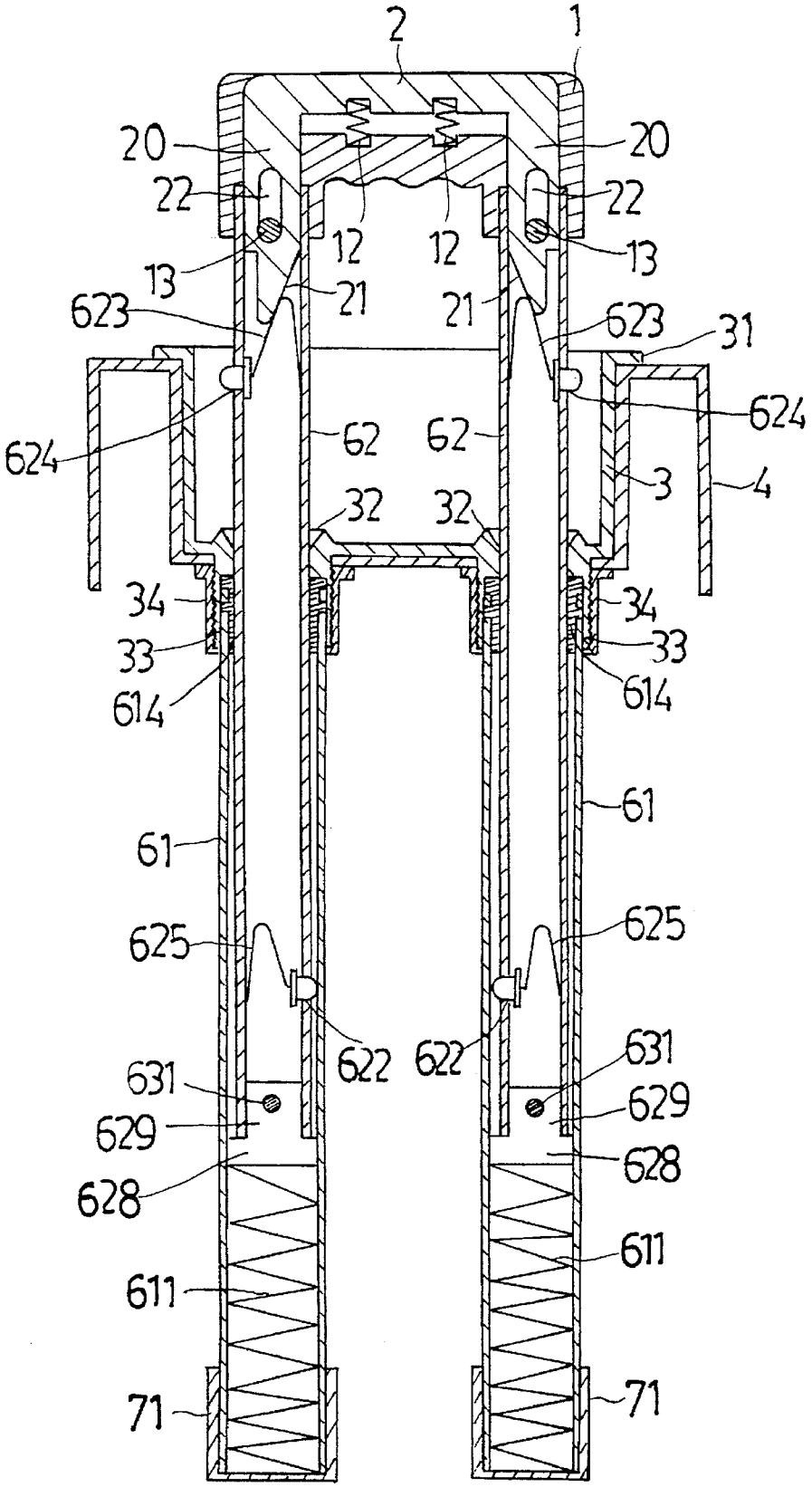
FIG. 8 is similar to FIG. 7 but showing the hand grip pulled upwards from the recessed mount.

Referring to FIG. 8, when the control bar 2 is depressed, the spring-supported retainer rods 623 are forced unwardly from the locating holes 617 of the sleeves 61 by the beveled tips 21 of the control bar 2 to release the engagement between the inner tubes 62 and the sleeves 61. When the inner tubes 62 are disengaged from the sleeves 61, the springs 611 force the inner tubes 62 upwardly to a certain distance, causing the hand grip 1 to be lifted from the cover frame 3, and at the same time the control bar 2 is forced back to its former position by the springs 12. Therefore, the hand grip 1 can be pulled to move the inner tubes 62 out of the sleeves 61.

Figure 9:
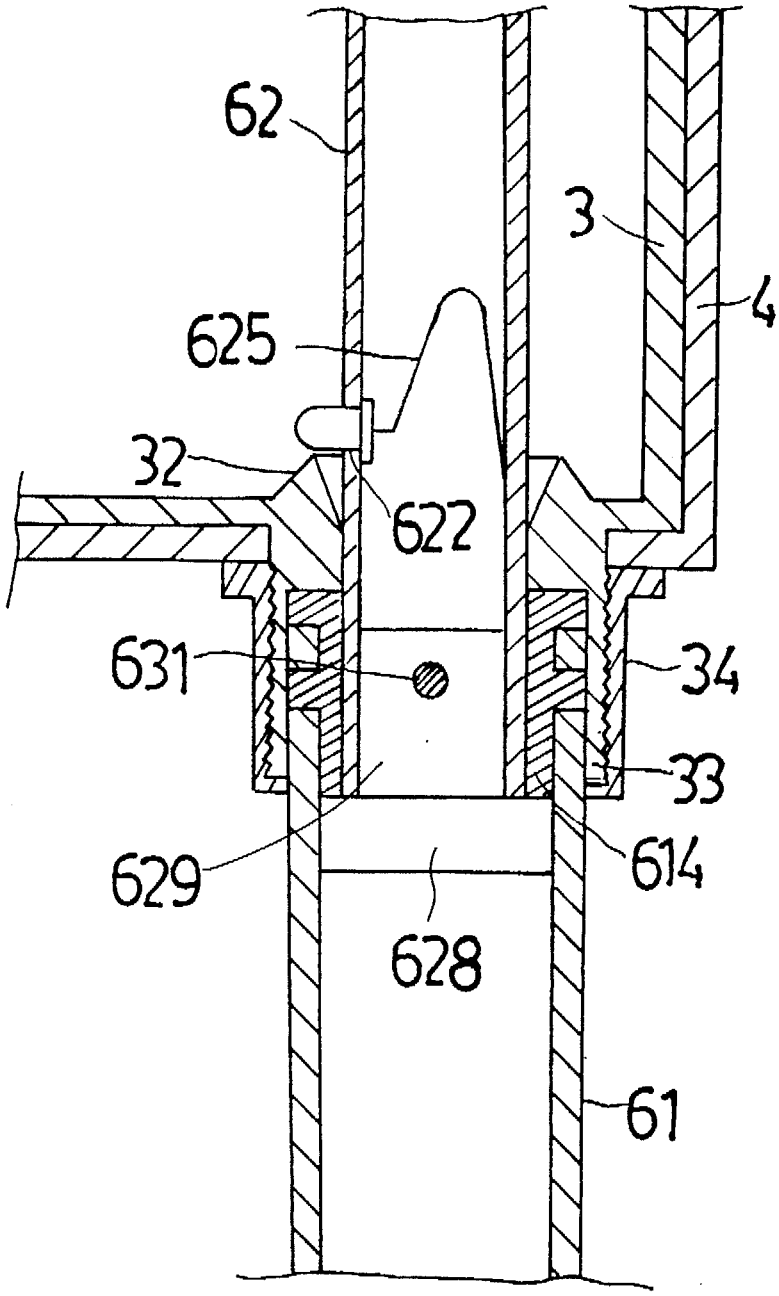
FIG. 9 is a partial view in section of the retractable handle shown in FIG. 6, showing the positioning of the inner tube in the sleeve.

Referring to FIG. 9, when the inner tubes 62 are respectively pulled out of the sleeves 61, the cap heads 628 of the bottom caps 621 of the inner tubes 62 are respectively stopped at the plug caps 614 inside the sleeves 61. Therefore, the inner tubes 62 do not escape out of the sleeves 61. At the same time, the spring-supported retainer rods 625 project out of the locating holes 622 and are stopped above the tapered bottom holes 32 of the cover frame 3 to hold the retractable handle in the operative position. When it is desired to place the retractable handle from the operative position to the collapsed position, the hand grip 1 is forced downwards to render a downward pressure to the inner tubes 62, thereby causing the spring-supported retainer rods 625 to be moved back inside the inner tubes 62. When the spring-supported retainer rods 625 are moved back inside the inner tubes 62, the inner tubes 62 can then be forced back into the inside of the sleeves 61.

I claim:

1. A retractable handle comprising:

a substantially U-shaped hand grip having two through holes at two opposite ends, and open top chamber, and two springs bilaterally mounted inside said top chamber;

a control bar dimensioned for insertion into the open top chamber of said hand grip and supported on the springs of said hand grip, said control bar having two legs at two opposite ends respectively inserted into the top chamber of said hand grip, each leg comprising a beveled tip, and an elongated hole near said beveled tip and the leg being slidably connected to the hand grip by a pin extending through a through hole of the hand grip and the elongated hole of the leg;

a recessed mount for mounting in a recessed top side of a travel bag, said recessed mount comprising a plurality of mounting holes respectively fastened to said travel bag by rivets, a receiving chamber, and two bottom through holes bilaterally disposed at a bottom side thereof;

a cover frame fitted into the receiving chamber of said recessed mount, said cover frame comprising an open chamber for receiving said hand grip and said control bar, two tapered bottom holes bilaterally disposed at a bottom side thereof, and two externally threaded bottom stub tubes respectively extending downwardly from the tapered bottom holes of the cover frame and through the bottom through holes of said recessed mount and each stub tube being secured in place by a respective lock nut;

a sleeve holder fixedly secured to the travel bag at a lower elevation relative to said recessed mount, said sleeve holder having two horizontally spaced receptacles;

two outer sleeves connected between the receptacles of said sleeve holder and the bottom stub tubes of said cover frame, each sleeve having a top end mounted with a plug cap and connected to one bottom through hole of said recessed mount, the plug cap being tubular and having a top flange dimensioned to be connected in the stub tube, a bottom end mounted with a spring on the inside and fixed to one of said receptacles of said sleeve holder, and a locating hole near said plug cap;

two inner tubes dimensioned to be slidably inserted into said sleeves, each inner tube comprising a top mounting hole, a bottom end fixedly mounted with a bottom cap, which is moved by the respective inner tube between the spring and plug cap of the respective sleeve, a top end, the legs of the control bar being inserted in the top ends, the pins slidably connecting the legs to the hand grip further extending through the top mounting holes of the inner tubes to connect same to the control bar and hand grip, a first locating hole and a second locating hole, the holes being at different elevations, a first spring-supported retainer rod extended out of said first locating hole and projecting into the locating hole on one sleeve, and a second spring-supported retainer rod extended out of said second locating hole and stopped against an inside wall of one sleeve; and whereby when said control bar is depressed, the beveled tips of said control bar are moved downwards to force the first spring-supported retainer rods of said inner tubes out of the locating holes on said sleeves, thereby permitting said inner tubes to be pushed upwards by the springs inside said sleeves, and therefore said inner tubes can be pulled out of said sleeves by said hand grip.

* * * * *